US005301468A

United States Patent [19]

Kamezaki

[11] Patent Number: 5,301,468

[45] Date of Patent: Apr. 12, 1994

[54] SLIDING DOOR

[75] Inventor: Masaaki Kamezaki, Iwai, Japan

[73] Assignee: Amsys Kabushiki Kaisha, Ibaragi, Japan

[21] Appl. No.: 924,971

[22] Filed: Aug. 5, 1992

[30] Foreign Application Priority Data

Aug. 16, 1991 [JP] Japan ..... 3-229583

[51] Int. Cl.[5] ..... E05D 15/10

[52] U.S. Cl. ..... 49/225; 49/209; 49/358

[58] Field of Search ..... 49/409, 410, 208, 211, 49/212, 209, 210, 222, 225, 358

[56] References Cited

U.S. PATENT DOCUMENTS

| | | | |
|---|---|---|---|
| 3,571,976 | 3/1971 | Schmid | 49/212 |
| 3,611,637 | 10/1971 | Saino | 49/410 |
| 4,404,770 | 9/1983 | Markus | 49/409 |
| 4,433,507 | 2/1984 | Chikaraishi | 49/410 |
| 4,476,652 | 10/1984 | Beauchot | 49/410 |
| 4,619,075 | 10/1986 | Wiles | 49/410 |
| 4,651,469 | 3/1987 | Ngian et al. | 49/409 |

*Primary Examiner*—Peter M. Cuomo
*Assistant Examiner*—Michael J. Milano
*Attorney, Agent, or Firm*—Fisher & Associates

[57] ABSTRACT

A sliding door adapted to operate an entrance of a large-sized freezer or the like and capable of facilitating operation at the initial stage of opening of the door. Upward elastic force of elastic suspensions constantly acts on a door body, so that the door body may be suspended while being raised from a floor, when the door is kept at an open position. Also, when the entrance is kept closed with the door, a driving wheel strikes on a tapered section of a lower rail surface to cause a bottom packing of the door body to be pressed on the floor against upward elastic force of the suspensions. Thus, when sliding of the door body toward the open position is started, the driving wheel is moved on the tapered section and concurrently the bottom packing of the door body is raised from the floor, during which the door body is moved obliquely upward and obliquely outward due to arrangement of the bracket assemblies and the like at the same inclination angle; so that a peripheral packing of the door body may be smoothly separated from a periphery of the entrance. Thus, frictional resistance does not substantially occur during the door opening operation, so that the operation is facilitated.

7 Claims, 5 Drawing Sheets

FIG. 4A
PRIOR ART
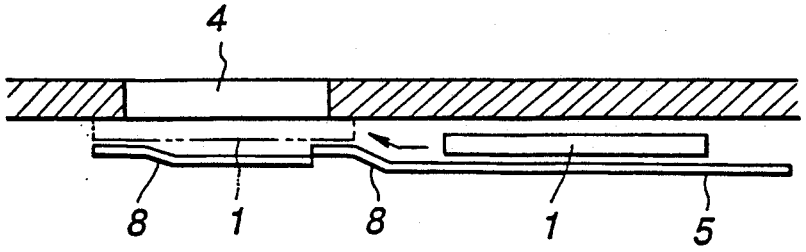
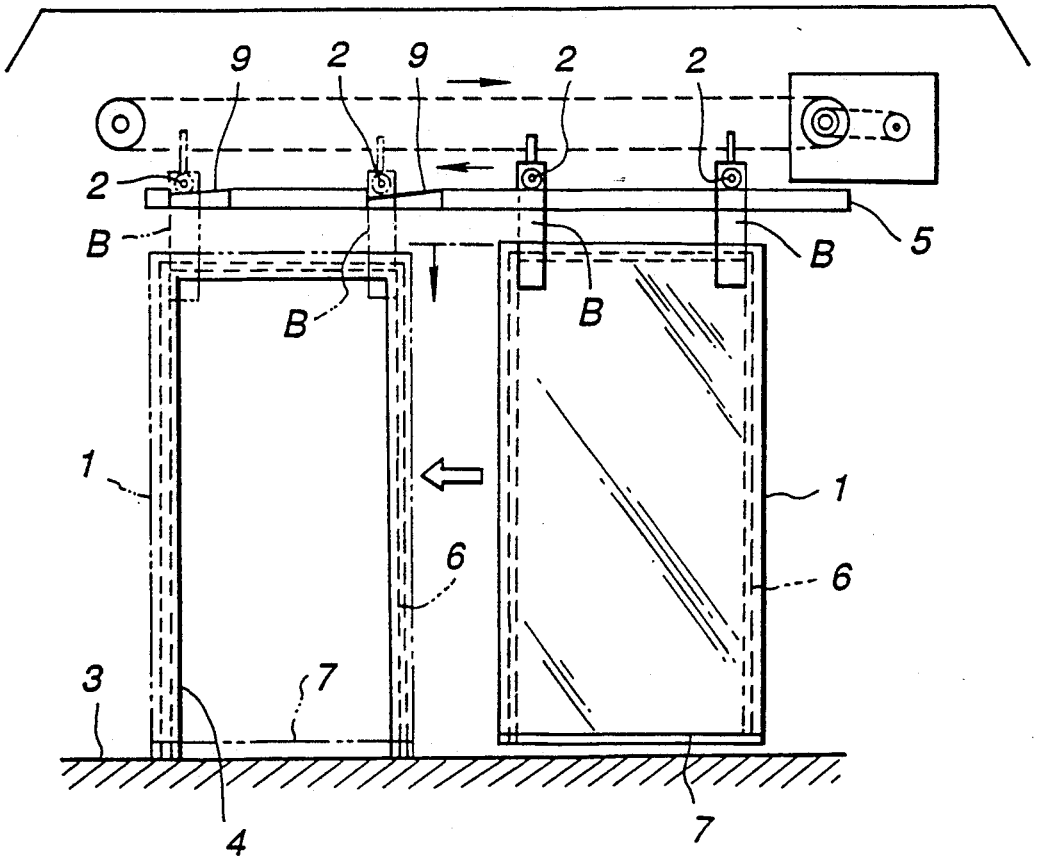
FIG. 4B
PRIOR ART

SLIDING DOOR

BACKGROUND OF THE INVENTION

This invention relates to a sliding door, and more particularly to a sliding door for air-tightly closing an entrance of a large-sized freezer, a large-sized refrigerator, a freezing storehouse, a refrigerating storehouse, a clean room or the like which is used for business purpose.

In general, such a sliding door is large-sized and formed into increased thickness and weight due to its heat insulating structure. Also, the conventional sliding door is so constructed that a packing arranged on a periphery of a door body is elastically closely contacted with a periphery of an entrance and a floor of a large-sized freezer or the like in order to provide the freezer with air-tightness when the entrance is closed with the door. Unfortunately, such construction causes much labor to be required at the initial stage of a door opening operation.

More particularly, for example, the conventional sliding door, as shown in FIGS. 4A and 4B, is so constructed that a wheel 2 rotatably mounted on each of brackets B fixed on an upper portion of a door body 1 is carried on a guide rail 5 horizontally arranged above an entrance 4 of an object to be operated with the sliding door such as a freezing storehouse or the like. The door body 1 is provided on a periphery of an inner surface thereof with a packing 6 and on a bottom thereof with a bottom packing 7. The guide rail 5 is formed at a portion thereof positionally corresponding to the entrance 4 with two sets of combinations each comprising an inward inclined portion 8 and a downward inclined portion 9.

In the above-described construction of the conventional sliding door, when the door body 1 reaches the entrance 4, the wheels 2 carried on the guide rail 5 are inward moved while being guided along the inward inclined portions 8, so that the peripheral packing 6 is pressed onto the periphery of the entrance 4. Concurrently, the wheels 2 are moved to the downward inclined portions 9 to cause the door body 1 to be lowered, resulting in the bottom packing 7 being pressedly contacted with the floor 3. Thus, the entrance 4 is air-tightly closed with the sliding door.

Unfortunately, the conventional sliding door 1 is large-sized and formed into weight as much as several tens of kilograms. Therefore, in order to open the door closed once, it is required to put out the wheels 2 from the downward inclined portions 9 against frictional resistance between the bottom packing 7 and the floor 3 while pushing up the weighty door. Concurrently, it is required to separate the peripheral packing 6 from the periphery of the entrance 4 against frictional resistance therebetween. Thus, starting of the door opening operation requires much labor.

Further, motorization of a sliding door recently takes place. However, in the conventional sliding door, as described above, much labor is required at the initial stage of the door opening operation, so that the motorization requires a motor of a large capacity. Thus, it causes problems such as an increase in manufacturing cost, an increase in operating cost, an increase in installation space and the like.

SUMMARY OF THE INVENTION

The present invention has been made in view of the foregoing disadvantage of the prior art.

Accordingly, it is an object of the present invention to provide a sliding door which is capable of exhibiting satisfactory operability.

It is another object of the present invention to provide a sliding door which is capable of substantially decreasing labor required at the initial stage of a door opening operation.

It is a further object of the present invention to provide a sliding door which is capable of being readily operated irrespective of a size of the door, its weight and the like.

It is still another object of the present invention to provide a sliding door which is capable of significantly decreasing a manufacturing cost and an installation space.

In accordance with the present invention, a sliding door is provided. The sliding door includes a door body and bracket assemblies. The bracket assemblies each include a first bracket on which a rolling wheel is rotatably supported and a second bracket arranged at a predetermined inclination angle and provided at an upper end thereof with an elastic suspension including an extensible rod. The first and second brackets are connected to each other through the extensible rod of the elastic suspension. The second bracket is mounted at a lower portion thereof on an upper portion of the door body. The sliding door also includes a rail including an upper rail surface and a lower rail surface and horizontally rigidly arranged above an entrance of an object to be operated by the sliding door such as a large-sized refrigerator or the like. The lower rail surface of the rail is arranged at the same inclination angle. The rolling wheel is carried on the upper rail surface of the rail, resulting in the door body being suspended by means of upward elastic force of the elastic suspension while being kept raised from a floor. Further, the sliding door includes a third bracket which is fixed at a lower portion thereof on an upper end of the door body and on which a driving wheel is rotatably supported while being slanted at the same angle as the bracket. The driving wheel is pressedly abutted against the lower rail surface by means of the upward elastic force of the elastic suspension, so that a distance between the floor and a bottom of the door body raised by the elastic force of the elastic suspension. The lower rail surface of the rail is formed on a position thereof rendered opposite to the driving wheel of the door body when the door body is moved to the closing position with a tapered section on which the driving wheel strikes to extend the extensible rod against the upward elastic force of the elastic suspension, resulting in the door body being obliquely inward downward moved forcibly.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIGS. 4A and 4B are a front elevation view and a plan view showing a conventional sliding door, respectively.

DETAILED DESCRIPTION OF THE PREFERRED EMBODIMENT

Now, a sliding door according to the present invention will be described hereinafter with reference to FIGS. 1 to 3.

Figure 1:
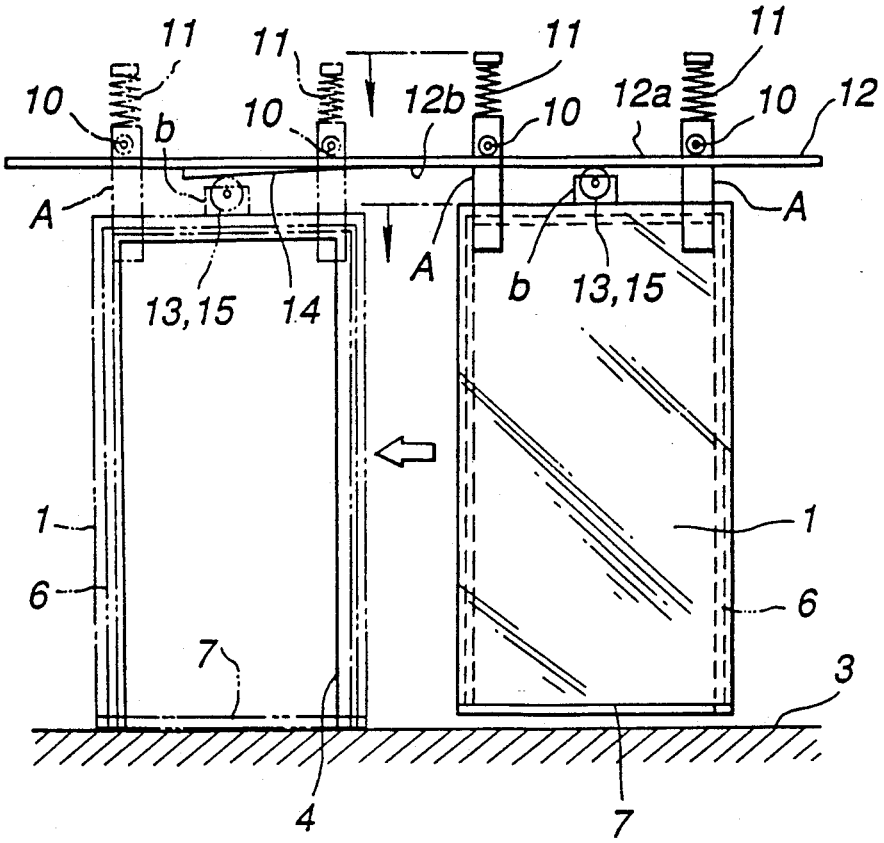
FIG. 1 is a front elevation view generally showing an embodiment of a sliding, door according to the present invention.
Figure 2:
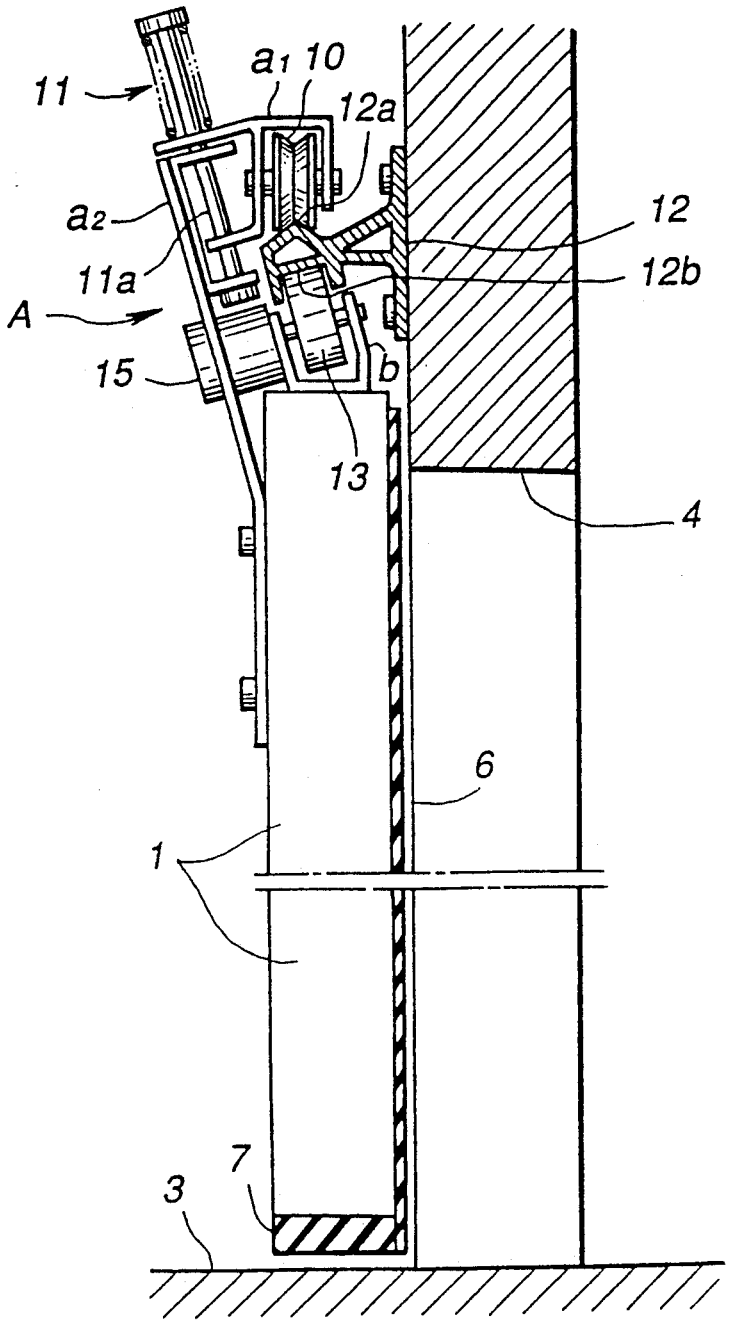
FIG. 2 is an enlarged side elevation view partly in section showing an essential part of the sliding door of FIG. 1 wherein the sliding door is at an open position.
Figure 3:
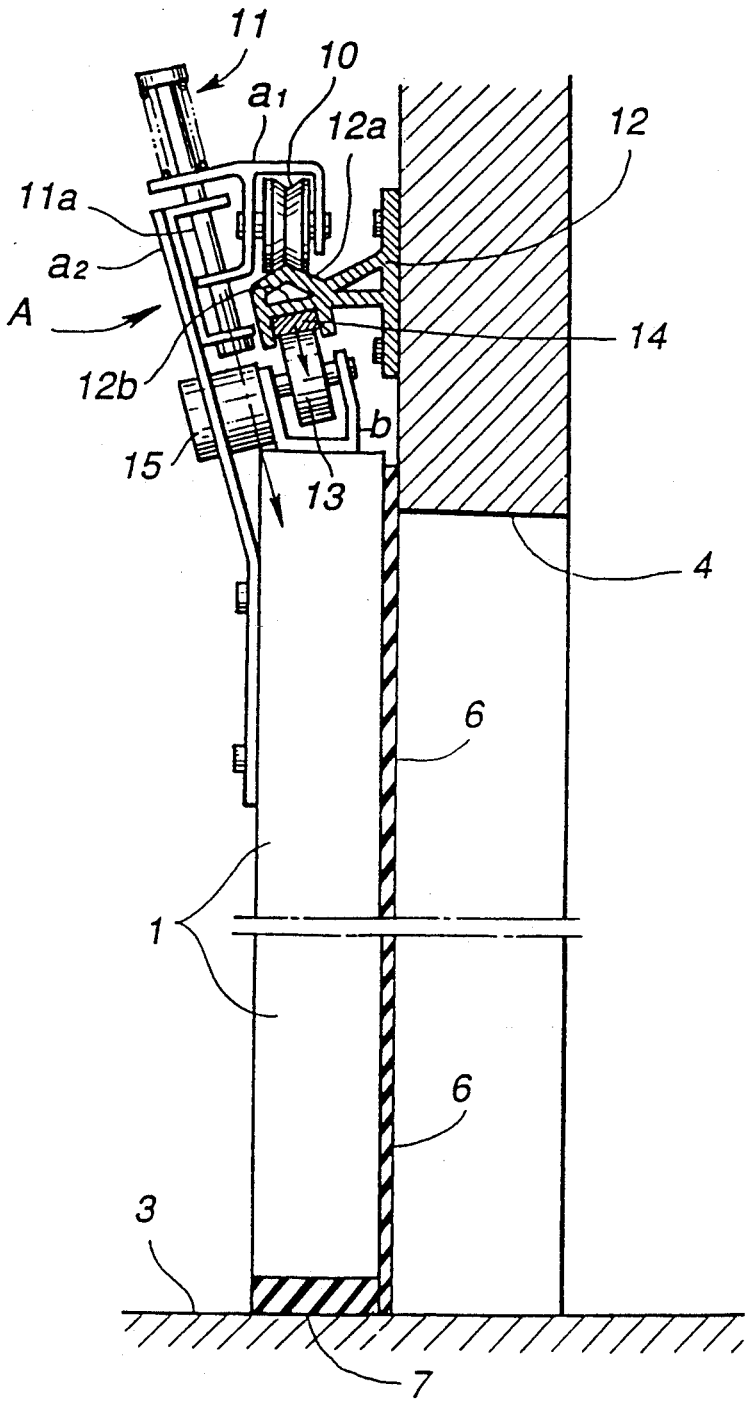
FIG. 3 is an enlarged side elevation view partly in section showing an essential part of the sliding door of FIG. 1 wherein the sliding door is at a closing position.
Figure 5:
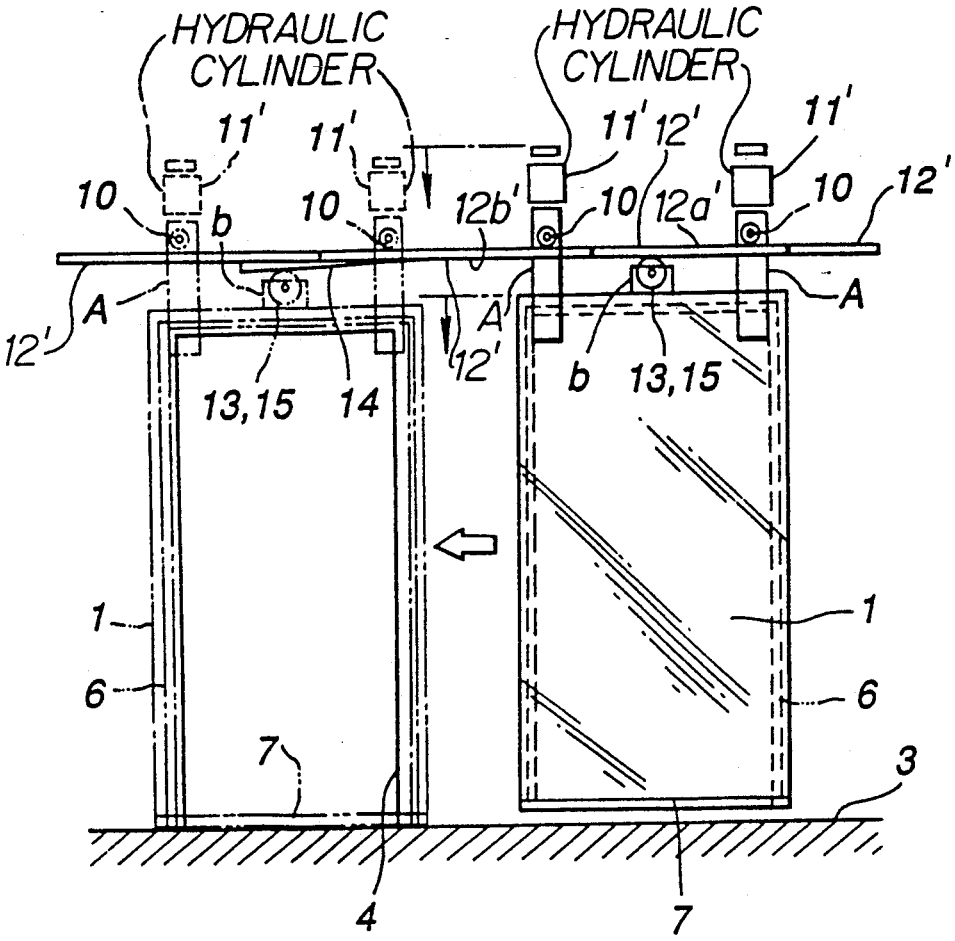
FIG. 5 is a front elevational view showing an alternate embodiment of the sliding door of FIG. 1.

FIGS. 1 to 3 illustrate an embodiment of a sliding door according to the present invention which is suitable for use for a large-sized refrigerator or the like.

A sliding door of the illustrated embodiment generally includes a door body 1 and a pair of bracket assemblies A arranged on an upper section of the door body 1 in a manner to be spaced from each other, as shown in FIG. 1, wherein solid lines indicate the sliding door at an open position and phantom lines indicate the door at a closing position. Each of the bracket assemblies A includes a first bracket $a_1$ on which a rolling wheel 10 is rotatably supported and a second bracket $a_2$ arranged at a predetermined inclination angle and provided at an upper end thereof with an elastic suspension 11 including an extensible rod $\mathbf{11}_a$. The first and second brackets are connected to each other through the extensible rod $\mathbf{11}_a$ of the elastic suspension 11. The second bracket $a_2$ is mounted at a lower portion thereof on an upper portion of the door body 1.

The sliding door also includes a rail 12 including an upper rail surface 12*a* and a lower rail surface 12*b* and horizontally rigidly arranged above an entrance 4 of an object to be operated by the sliding door such as a large-sized refrigerator or the like. The lower rail surface 12*b* of the rail 12 is arranged at the same inclination angle as the second bracket $a_2$. The rolling wheel 10 is carried on the upper rail portion 12*a* of the rail 12, resulting in the door body 1 being suspended by means of upward elastic force of the elastic suspension 11 while being kept raised from a floor 3 on which the object is installed.

Further, the sliding door includes a third bracket b which, in the illustrated embodiment, is arranged between the bracket assemblies A. The third bracket b is fixed at a lower portion thereof on an upper end of the door body 1 and on which a driving wheel 13 is rotatably supported while being slanted at the same angle as the bracket $a_2$. The driving wheel 13 is pressedly abutted against the lower rail surface 12*b* by means of the upward elastic force of the elastic suspension 11, so that a distance between the floor 3 and a bottom of door body 1 raised by the elastic force of the elastic suspension 11 or, in the illustrated embodiment, a packing 7 provided on the bottom surface of the door body 1 is controlled. The lower rail surface 12*b* of the rail 12 is formed on a position thereof rendered opposite to the driving wheel 13 of the door body 1 when the door body 1 is moved to the closing position with a tapered section 14 on which the driving wheel strikes to extend the extensible rod 11*a* against the upward elastic force of the elastic suspension 11, resulting in the door body 1 being obliquely inward downward moved forcibly. The door body 1 is provided on an inner periphery thereof with peripheral packing 6.

The sliding door of the illustrated embodiment may be manually operated. Alternatively, it may be motorized by providing a motor 15 for driving the driving wheel 13. In the illustrated embodiment, the motor 15 is mounted on the third bracket b and operatively connected to the driving wheel 13.

The elastic suspension 11 provided on the second bracket $a_2$, in the illustrated embodiment, comprises a coiled spring mounted on the extensible rod 11*a*. Alternatively, it may comprise a hydraulic cylinder or an air cylinder 11'.

The tapered section 14 of the lower rail surface 12*b* of the rail 12, in the illustrated embodiment, comprises a tapered member provided separate from the rail 12 and mounted on the lower rail surface 12*b*. Alternatively, it may be integrally formed on the lower rail surface so as to be projected therefrom.

In the illustrated embodiment, the rail 12 comprises a single rail member formed with the upper rail surface 12*a* and lower rail surface 12*b*. Such construction of the rail 12 permits the sliding door of the present invention to be more efficient. Alternatively, it may comprise a combination of rail members 12' formed separate from each other and provided with the upper rail surface 12*a'* and lower rail surface 12*b'*, respectively.

The sliding door of the illustrated embodiment is constructed in the form of a single sliding door. However, it is readily applied to a double sliding door. In this instance, an additional sliding door of the same construction is arranged in a manner to be symmetrical with respect to the sliding door of the illustrated embodiment.

Now, the manner of operation of the sliding door of the illustrated embodiment will be described hereinafter.

When the sliding door is at the open position, the door body 1 is raised from the floor 3 by the upward elastic force of the suspensions 11 while being suspended on the upper rail surface 12*a* of the rail 12. The distance between the bottom of the door body 1 and the floor 3 is controlled due to pressed abutment of the driving wheel 13 against the lower rail surface 12*b*. Thus, the door body 1 is ready to be smoothly moved through the driving wheel 13 manually or by actuation of the driving motor 15.

Then, when the door body 1 is moved toward the entrance 4, the driving wheel 13 strikes on the tapered section 14 of the lower rail surface 12*b* of the rail 12 as shown in FIG. 3, so that pressing force is downward applied to the driving wheel 13, bracket b and door body 1 in turn. This causes the bracket $a_2$ of each of the bracket assemblies A fixed on the door body 1 to downward move while compressing the coiled spring of the suspension 11 against the upward elastic force of the suspension 11 to extend the extensible rod 11*a*, during which the rolling wheels 10 carried on the upper rail surface 12*a* and the brackets $a_1$ are kept at the original position. Also, the brackets $a_2$, elastic suspensions 11, extensible rods 11*a*, bracket b, driving wheel 13, lower rail surface 12*b* and tapered section 14 are arranged at the same inclination angle, therefore, the door body 1 is forced obliquely downward, as well as obliquely inward, resulting in being moved toward the entrance 4. Then, the peripheral packing 6 of the door body 1 is closely contacted with an outer periphery of the entrance 4 and concurrently the bottom packing 7 is closely contacted with the floor 3, so that the entrance 4 is hermetically closed with the door body 1.

Thereafter, when the door body 1 is moved toward the open position through the driving wheel 13 manually or by the driving motor 15, the upward elastic force of each of the elastic suspensions 11 constantly acts on the whole door body 1 to raise it. Thus, immediately after the driving wheel 13 is moved to the tapered section 14, the bottom packing 7 is upward separated from the floor 3; thus, movement of the sliding door to the closing position can be smoothly carried out.

As can be seen from the foregoing, the sliding door of the present invention is so constructed that the upward elastic force of the elastic suspensions constantly acts on the door body, so that the door body may be suspended while being raised from the floor when the door is kept at the open position. Also, in the sliding door of the present invention, when the entrance is kept closed with the door, the driving wheel strikes on the tapered section of the lower rail surface to cause the bottom packing of the door body to be pressed on the floor against the upward elastic force of the suspensions. Therefore, when sliding of the door body toward the open position is started, the driving wheel is moved on the tapered section of the lower rail surface while rolling and concurrently the bottom packing of the door body is raised from the floor, during which the door body is moved obliquely upward and obliquely outward due to arrangement of the bracket assemblies A and the like at the same inclination angle; so that the peripheral packing of the door body may be smoothly separated from the periphery of the entrance. Thus, no resistance occurs during the door opening operation except slight frictional resistance produced between the bottom packing and the floor at the initial stage of the door opening operation.

On the contrary, the conventional sliding door, as described above, exhibits a disadvantage that much labor is required due to a weight of the door and frictional resistance between a packing and a wall or a floor at the initial stage of a door opening operation, resulting in a size of the door and its weight being subject to restriction and a motor of a large capacity being required. The sliding door of the present invention eliminates the disadvantage of the prior art and ensures smooth operation at the initial stage of opening of the door irrespective of a size of the door, its weight and the like.

Also, in the conventional sliding door, it is required to form a rail with an inward slanting portion and a downward slanting portion by precision-working. On the contrary, the rail used in the present invention may be a rail simplified in structure and the tapered section may be readily mounted on the rail. Thus, in the present invention, a continuous rail as cut may be used as the rail.

Further, motorization of the conventional sliding door requires a motor of a large capacity, as well as a chain driving mechanism wherein a chain is arranged along the rail and connected to a bracket of the door, resulting in an increase in installation space and an increase in manufacturing cost. On the contrary, the sliding door of the present invention eliminates the disadvantage of the prior art because it merely requires a motor of a small capacity and the motor is merely arranged on the third bracket for the driving wheel.

What is claimed is:

1. A sliding door comprising:

a door body;

bracket assemblies each including a first bracket on which a rolling wheel is rotatably supported and a second bracket arranged at a predetermined inclination angle and provided at an upper end thereof with an elastic suspension including an extensible rod, said first and second brackets being connected to each other through said extensible rod of said elastic suspension;

said second bracket being mounted at a lower portion thereof on an upper portion of said door body;

a rail including an upper rail surface and a lower rail surface and horizontally rigidly arranged above an entrance of an object to be operated by said sliding door;

said lower rail surface of said rail being slanted at the same angle as said second bracket;

said rolling wheel being carried on said upper rail surface of said rail, resulting in said door body being suspended by means of upward elastic force of said elastic suspension while being kept raised from a floor on which said object is installed; and a third bracket which is fixed at a lower portion thereof on an upper end of said door body and on which a driving wheel is rotatably supported while being slanted at the same angle as said bracket;

said driving wheel being pressedly abutted against said lower rail surface by means of the upward elastic force of said elastic suspension;

said lower rail surface of said rail being formed on a position thereof rendered opposite to said driving wheel of said door body when said door body is moved to the closing position with a tapered section on which said driving wheel strikes to extend said extensible rod against the upward elastic force of said elastic suspension, resulting in said door body being obliquely inward downward moved forcibly.

2. A sliding door as defined in claim 1, wherein further comprising a motor for driving said driving wheel.

3. A sliding door as defined in claim 1, wherein said elastic suspension provided on said second bracket comprises a coiled spring.

4. A sliding door as defined in claim 1, wherein said elastic suspension provided on said second bracket comprises a hydraulic cylinder.

5. A sliding door as defined in claim 1, wherein said elastic suspension provided on said second bracket comprises an air cylinder.

6. A sliding door as defined in claim 1, wherein said rail comprises a single rail member formed with said upper rail surface and said lower rail surface.

7. A sliding door as defined in claim 1, wherein said rail comprises a combination of rail members formed separate from each other and provided with the upper rail surface and lower rail surface, respectively.

* * * * *